US006131313A

United States Patent [19]

Pierce et al.

[11] Patent Number: 6,131,313

[45] Date of Patent: Oct. 17, 2000

[54] INJURY PREVENTING SKI BOOT

[75] Inventors: Javin C. Pierce; Charles K. Adams, both of Stowe, Vt.

[73] Assignee: Lange International S.A., Switzerland

[21] Appl. No.: 09/091,390

[22] PCT Filed: Dec. 19, 1996

[86] PCT No.: PCT/US96/20203

§ 371 Date: Jun. 19, 1998

§ 102(e) Date: Jun. 19, 1998

[87] PCT Pub. No.: WO97/22271

PCT Pub. Date: Jun. 26, 1997

[51] Int. Cl.[7] ..... A43B 5/00

[52] U.S. Cl. ..... 36/118.3; 36/118.7

[58] Field of Search ..... 36/118.3, 118.4, 36/118.7, 117.1

[56] References Cited

U.S. PATENT DOCUMENTS

| | | | |
|---|---|---|---|
| 4,519,159 | 5/1985 | Arieh et al. | 36/121 |
| 4,761,899 | 8/1988 | Marxer | 36/121 |
| 4,821,433 | 4/1989 | Marxzer | 36/121 |
| 5,107,608 | 4/1992 | Kreitenberg | 36/117 |
| 5,283,964 | 2/1994 | Chemello | 36/117 |

*Primary Examiner*—M. D. Patterson

*Attorney, Agent, or Firm*—Hayes, Soloway, Hennessey, Grossman & Hage, P.C.

[57] ABSTRACT

A ski boot comprising a rigid foot portion having a rigid base and a rigid upper for surrounding essentially a foot of a wearer, a rigid leg element for surrounding essentially a lower portion of a leg of the wearer including a pivot, the foot portion and the leg element being connected through the pivot to constitute a forward leaning retention position for the wearer, and a release and retention mechanism for changing the rigid leg element into a substantially vertical release stop position. The said release stop position is the result of a predetermined rearward force on the wearer's leg. The release mechanism comprises an upper arm linkage engaged to a lower arm linkage through a slot. The release mechanism converts the rearward force into a substantially downward force which force causes the upper arm linkage to travel downwardly in the slot at which point the lower arm linkage and upper arm linkage contact one another and pivot outwardly from the boot to position the wearer's leg into the release stop position.

10 Claims, 10 Drawing Sheets

INJURY PREVENTING SKI BOOT

BACKGROUND OF THE INVENTION (1) Field of the Invention

The present invention relates to a retention and release mechanism providing a safety feature in ski boots. More specifically, the present invention relates to the prevention and mitigation of the severity of injuries to the anterior cruciate knee ligament. This invention also relates to a construction of the ski boot upper to provide a safe biomechanically natural rearward articulation.

(2) Description of the Prior Art

Various prior art devices have been described relating to improving against injury in the sport of downhill skiing. The vast majority of these disclosures relate to improvements in the ski binding; i.e. that mechanism which is affixed directly to the ski. In addition, there have been some disclosures regarding modification to the ski boot itself but more so from the point of view of providing a mechanism for the wearer to more readily step into and out of the boot. For example, in U.S. Pat. No. 5,136,794 there is reported a ski boot consisting of a lower part and of a shaft, in the form of a collar, which is articulated on the lower part and provided with at least one closing buckle. The shaft comprises, at the rear, a rocker which interacts with a stop which is integral with the lower part in order to lock the shaft in a position inclined forwards. The rocker is held in inactive position upon opening of the uppermost buckle by means of a cable and a spring. Thus, the shaft does not come to be locked at the wrong moment during walking.

Attention is also directed to U.S. Pat. No. 5,127,171, and art cited therein, which discloses a ski boot with a shell comprising a shaft in two parts, the rear part of which is connected, on the one hand, to the shell and, on the other hand, to the front part of the shaft by two pair of links. The axis of the articulations on the rear part are situated, in the closed position of the boot, on one side and the other of the plane containing the axes of articulation on the shaft and the front part of the shaft. It is possible to open the shaft wide for putting the boot on, while having only a limited tilting backwards of the rear part. The upper connection can be associated with a closing lever.

In U.S. Pat. No. 5,107,608, there is disclosed a ski boot for lessening the incidence of knee injuries which the boot is said to exert a forward directional force on the skier's leg. A releasing means changes the rigid support position for the foot and the lower leg on application of a predetermined level of force by the boot on the wearer. The '608 disclosure goes on to report that rearward pressure of the person's lower leg against the rear leg element of the boot can be sensed by force sensors producing electrical outputs by the use of piezoelectric material. In addition, as illustrated in FIG. 7 therein., a mechanical latch assembly employing a tension spring 96 is disclosed, which is described as urging or maintaining the device in ski position, and when said tension is overcome, a release position is obtained as shown in FIG. 8.

U.S. Pat. No. 5.283,964 discloses a boot device for front-to-back immobilization of the upper, which acts on an oscillating level capable of being supported against a stop on the shell base. The device is constituted by a rectilinear-motion control mechanism incorporating an external control device of which an inner part actuates via a cam a sensing device associated with the oscillating lever so as to impart to the latter an angular rotating movement around its pin toward a locked or release position in relation to the stop formed on the shell base.

Attention is also directed to following foreign patent documents: WO 92/05718 and 0514762A2. More specifically, in WO 92/05718 there is disclosed a ski boot for enhancing the safety of skiing. Finally, reference is made to EP-375-604-A, which discloses a ski boot with stop holding the leg forward, and French Patent 2647-649-A which discloses a ski boot with an articulated leg locked in a forward position, which leg is articulated having a clip at the back which pivots around the horizontal axis.

All of the above, however, are distinct from the present invention, in that they collectively fail to provide, in the boot itself, a practical mechanism for mitigation of knee injuries while used in skiing. Accordingly, in the context of the present invention, there is herein provided in the boot a retention and release mechanism which specifically reduces potentially injurious forces to the anterior cruciate knee ligament (ACL). Stated another way, the present invention is designed to provide a ski boot that allows the potentially damaging posterior forces at the spoiler (or upper shaft) section of a ski boot to be absorbed or transduced.

Therefore, it is an object of the invention to provide a ski boot design which restricts the posterior movement of the upper shaft of a ski boot, by allowing posterior travel of the same after a selected level or threshold of force has been obtained.

In addition, the present invention also contains as its objective the development of a unique mechanism to affect cuff displacement and arrest when appropriate to create a more safe environment and enhanced safety to the user.

Moreover, the present invention has as its object the preparation of a retention and release mechanism providing a safety feature in a ski boot design.

Finally, it is a more specific object of the invention to provide a ski boot design which prevents or mitigates the severity of injuries to the anterior cruciate knee ligament, and to provide a more safe natural biomechanical rearward articulation, in the boot, for the user thereof.

SUMMARY OF THE INVENTION

The present invention, as will be described in further detail accommodates a range of lower leg angles from about 12 to 15 to about 0 to −3 degrees without causing ankle injury or discomfort. Inherent in the design herein is the feature that the recovery is possible (via stance adjustment with respect to the contralateral leg, combined with the "stop" or limit of rearward movement, supporting the leg) and injury to the ankle is prevented via leg support and reduction of portions of the boot lower that would impinge upon the leg/ankle in rearward motion (plantar flexion). In addition, the moment arm of the ski tail of the present invention is reduced with respect to the skiers' center of gravity thereby reducing forces to the knee while still providing posterior support of the leg and thereby permitting the skier to continue skiing until recovery or falling. In the case of falling, rearward contact with the snow over the ski tail requires less derangement and force loading of the knee joint.

In addition to the above, the present invention provides the ability for the user to adjust and allow for movement into a walking position of about −12 to −15 degrees, by adjustment of the device herein at the boot lower section thereof.

Furthermore, in the predominant backward falling accidental instance when episodes of ACL force is likely to cause a rupture, the flexion of the knee is greater than 90 degrees from full extension (straight), the flexion angle tends to be reduced, by the present invention, when rearward support is again offered by the boot taking advantage of more equitable load sharing of fibers within the ACL. See *Anterior Cruciate Ligament Strain In Vivo*, Robert J. Johnson et al, Univ. of Vt., Proceedings of the American Academy of Orthopaedic Surgeons, 1989. Specifically, loads are reduced in the anterior medical fiber bundle and redistributed to the posterior lateral fibers of the ACL, as a consequence of release to the approximate 0 degree position.

Coversely, in the less common potential ACL injury episode when the posterior boot support imparts a dangerous force to the knee when the knee is nearly or fully extended (straight), the present invention can permit the knee flexion angle to be increased when rearward support is again offered by the boot again taking advantage of more equitable load sharing of fibers within the ACL. Specifically load concentrations are distributed from the posterior lateral fiber bundle to the anterior medial fibers.

In sum, the present invention comprises a ski boot which provides a mechanical retention and release mechanism providing means for mitigating injury to the anterior cruciate knee ligament when the skier exerts posterior loads, potentially injurious to the knee, to the boot shaft upper, said retention and release mechanism capable of positioning lower leg angles from about +12 to 15 degrees in said retention position, to about 0 to −3 degrees, in a release position.

DESCRIPTION OF PREFERRED EMBODIMENT

Figure 1:
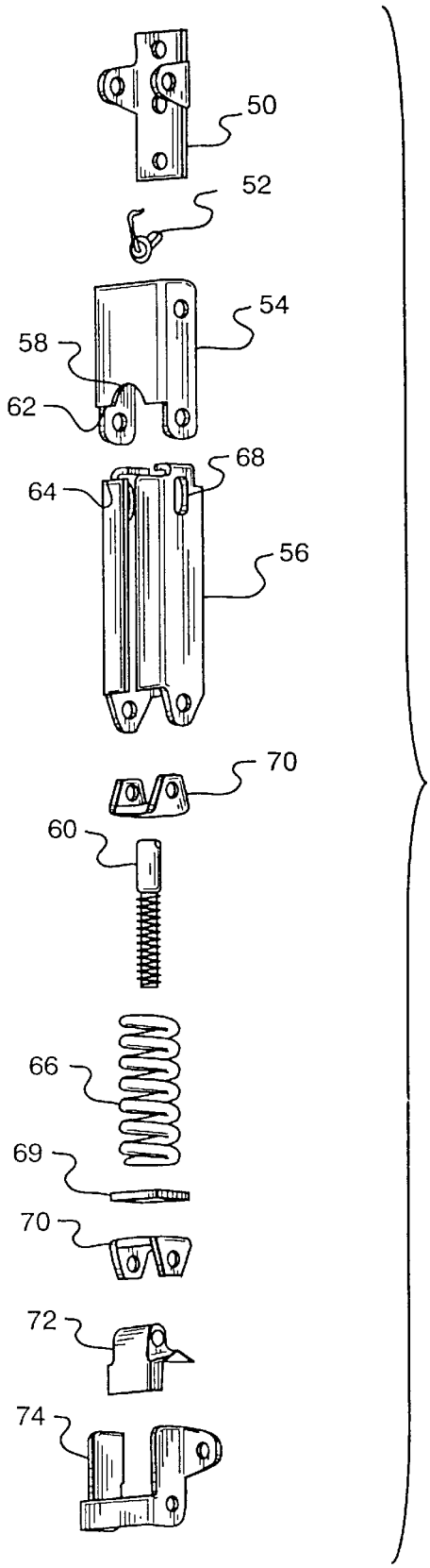
FIG. 1 is an exploded view of the retention and release mechanism of the present invention.

Referring to FIG. 1, the present invention comprises a retention and release mechanism comprising a plate 50 which is affixed to a ski boot upper shaft by a pair of fixation tabs to allow hinged fixation, a spring 52 mounted on a single hinge pin under compression to provide sufficient anterior force with respect to the ski boot to induce said upper and lower arm linkages to remain against the posterior element of the ski boot while skiing or to return said armatures to a stable position after release, said spring having insufficient force to prevent the armatures from moving posteriorly to an unstable configuration during release, an upper arm linkage 54 comprising a pair of hinge pin receiving holes for pivotal fixation to said plate 50 and a pair of receiving holes for pivotal fixation to a lower arm linkage 56 comprising a space 58 to permit tool access to adjustment screw 60 and an interference edge 62. The interference edge 62 is in spatial relationship with a coacting interference edge 64 of lower arm linkage 56 such that linkage elements 56 and 54 revert from a stable (anterior coacting with the boot) to an unstable position (posterior) when a predetermined amount of spring 66 deflection/compression has occurred. The lower arm linkage 56, as noted, contains interference edge 64 and a pair of receiving slots 68 to provide hinged fixation to upper arm linkage 54 and axial translation of 54 with respect to 56. The spring compression cap 59 contains a pair of holes to hold a pair of short hinge pins that connect 54 and 56 and a central axial hole to permit access to spring 66. The release tension adjustment screw 60 contains a capless head to prevent axial loading/interference of spring 66 yet with sufficient keyway interface to permit turning by a tool. The head stays within the spring coils. At 69 is a square threaded compression nut comprising a threaded axially orientated receiving hole for adjustment screw 60 of sufficient width to prevent rotation during tension adjustment, also comprising a visual indicator of spring tension against a scale (not shown). Adjustment screw thrust plate 70 comprises a central indentation strike point for adjustment screw 60 by which inferior spring force is transduced to 56 via tabs comprising a pair of holes for receiving a hinge pin rigidly affixing 70 to 56. At 72 is a cam that supports the release and retention mechanism upon a spring load latch (not shown) whereby the cam can be urged (by means not shown) to pivot anteriorly a sufficient amount to disengage from supporting latch allowing inferior translation of the release and retention mechanism and posterior motion of the boot upper shaft to permit walking, ingress and egress. At 74 is a stirrup mounting bracket which comprises a pair of holes for fixation by screws to a stirrup (lower outer shell cuff element), a pair of holes for receiving a hinge pin and pivotal affixation of 72 and 74 to 70 and 56. Furthermore 74 contains a strike plate coacting with 72 to prevent excessive posterior rotation of 72 providing a stable support configuration until 72 is urged forward to assume a "walk" mode.

Figure 2:
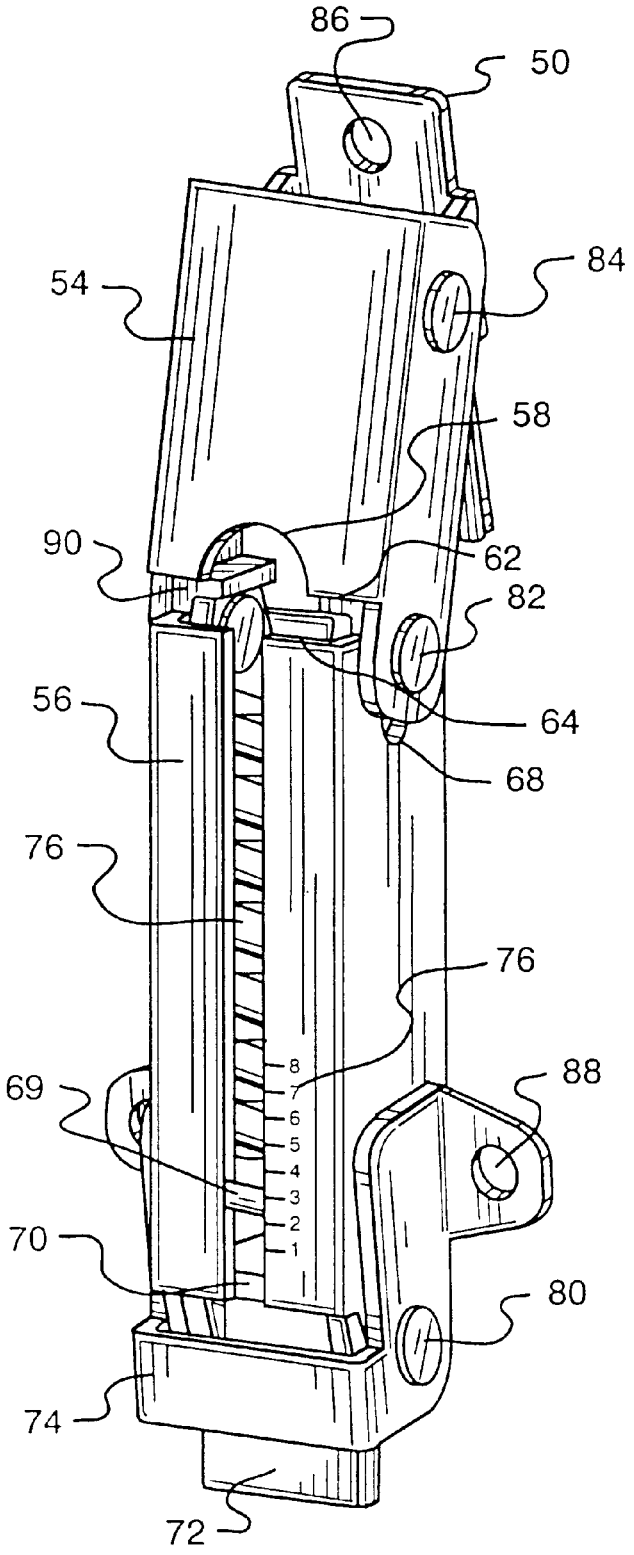
FIG. 2 is an assembled view of the release and retention mechanism of FIG. 5.

FIG. 2 is an assembled illustration of the release and retention mechanism of FIG. 1. Shown again in assembled form are the plate 50, the upper arm linkage 54, interference edge 62, which can also be termed a superior interference contact edge, interference edge 64, which can also be termed an inferior contact edge, lower arm linkage 56, stirrup mounting bracket 74 and cam 72. Also illustrated in FIG. 1 are the adjustment screw thrust plate 70 and square threaded compression nut 69. Finally, FIG. 1 also shows at 74 the stirrup mounting bracket, at 76 the visual tension indicator, at 80 the hinge pin head, at 82 the short hinge pin head, at 84 the head of the single hinge pin, and at 86 the rivet mounting hole of plate 50. Finally, at 88 is illustrated a hinge pin head, and at 90 is shown the flange of 56 that acts to a shoulder to augment the travel limit of spring cap (internal, not shown) against the top of the slot.

Figure 3:
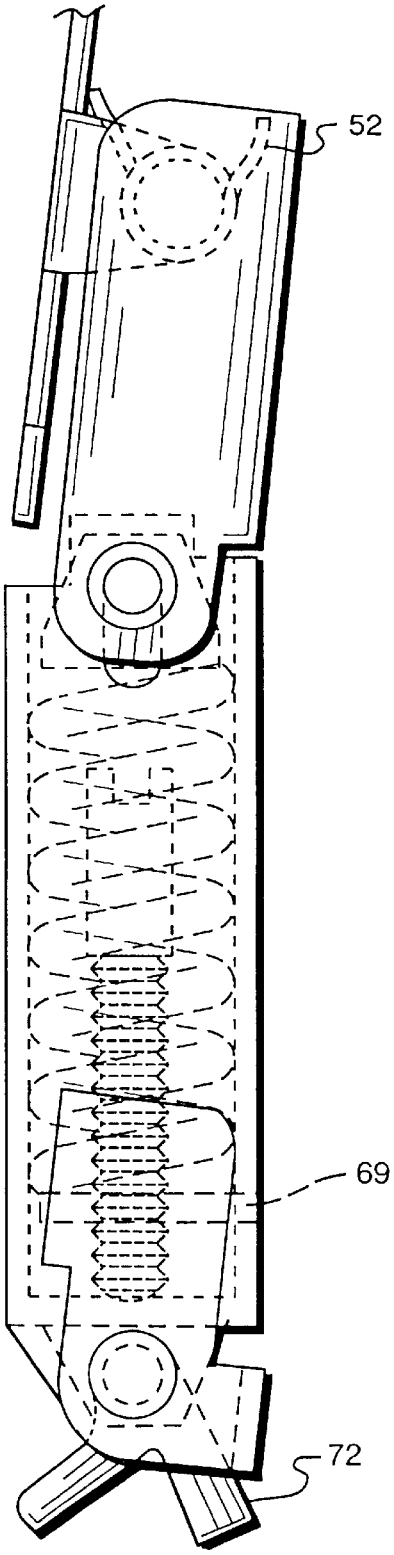
FIG. 3 is a side elevational view, in partial cross section, of the release and retention mechanism of FIG. 5.
Figure 4:
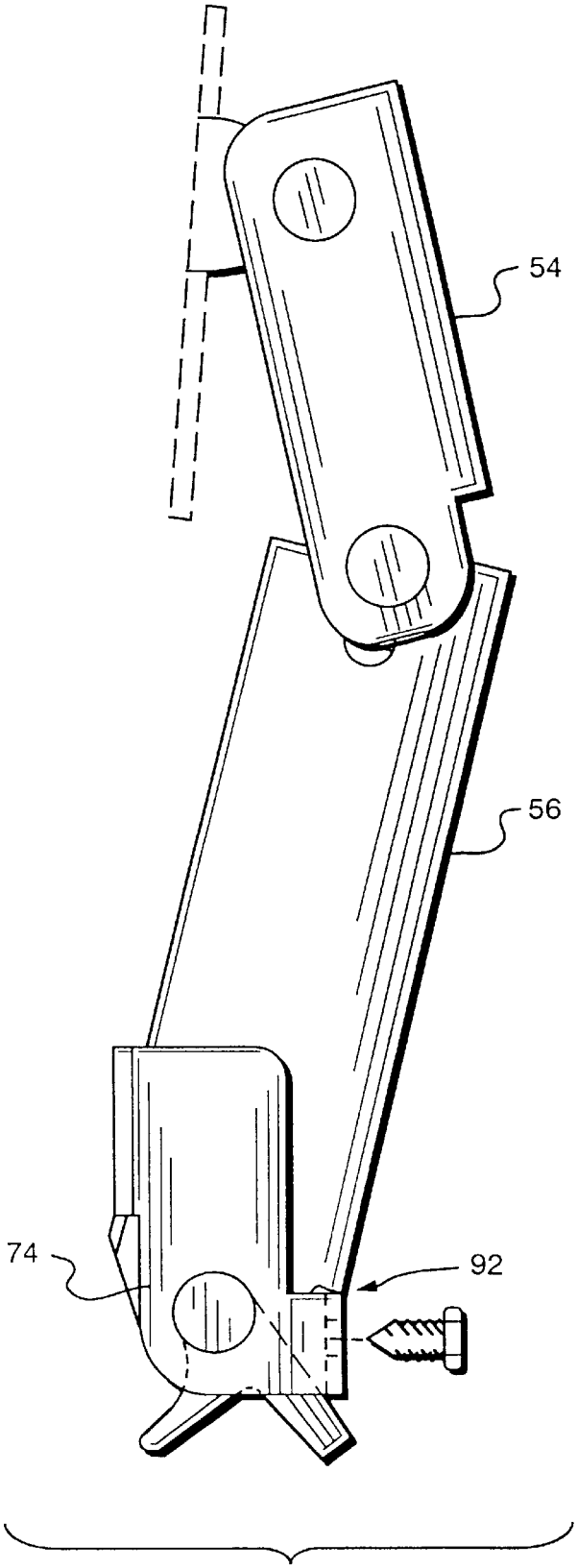
FIG. 4 is a side elevational view illustrating the release and retention mechanism of FIG. 5 in the release position.
Figure 5:
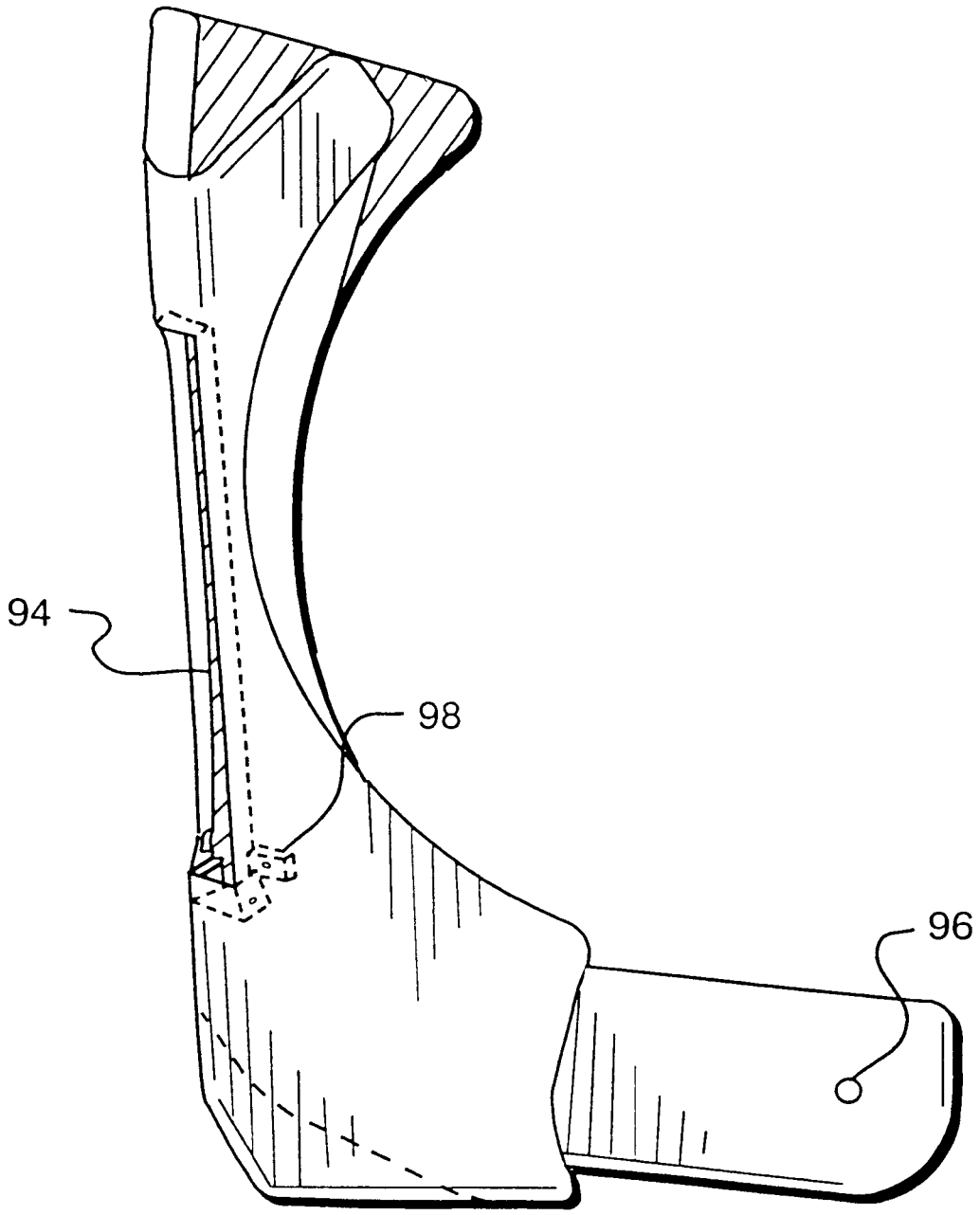
FIG. 5 is a side elevational view illustrating the cutout section of the boot in the stirrup cuff element of the present invention.

FIG. 3 illustrates in further cross-sectional view the release and retention mechanism, in the ski position, more clearly showing the placement of spring 52. The front of the boot is to the left hand side of the release and retention mechanism shown in FIG. 7. FIG. 4 illustrates the release and retention mechanism is release position. Also shown in FIG. 4 at 92 is the contact which occurs as between lower arm linkage and stirrup mounting bracket 74 which further serves to limit travel of the upper arm linkage 54. FIG. 5 illustrates at 94 the cutout section of the boot in the stirrup cuff element for placement of the release and retention device herein, at 96 the stirrup pivot point which rivets to the lower shell of the boot, and finally, at 98, one of the screw hole pairs for mounting the stirrup mounting bracket 74.

Figure 6:
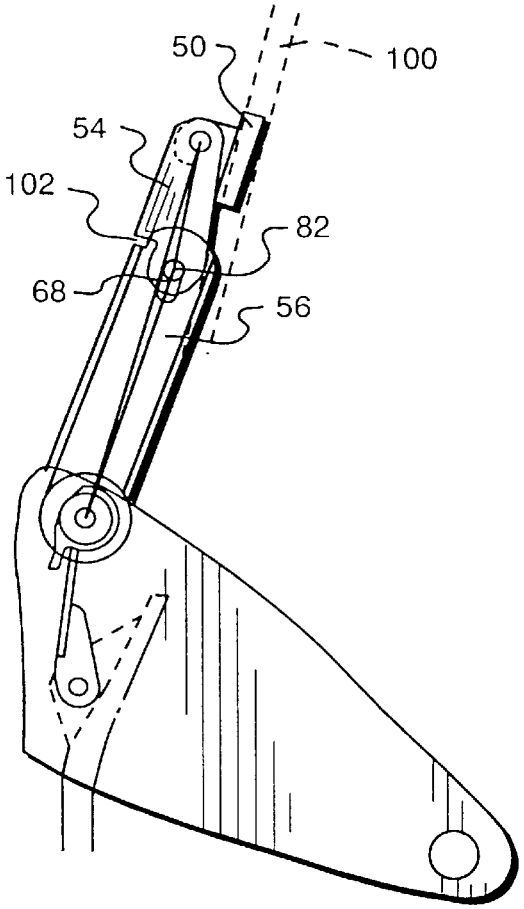
FIGS. 6–8 illustrate in side elevation view the release and retention mechanism of the present invention in both retention and release positions.
Figure 7:
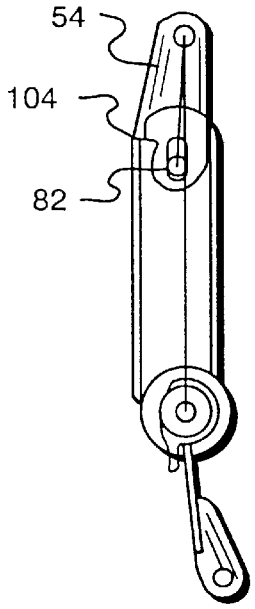
Figure 8:
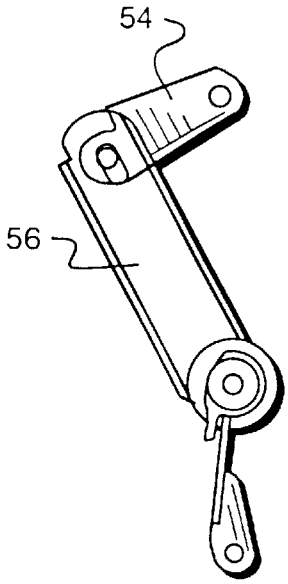
Figure 11:
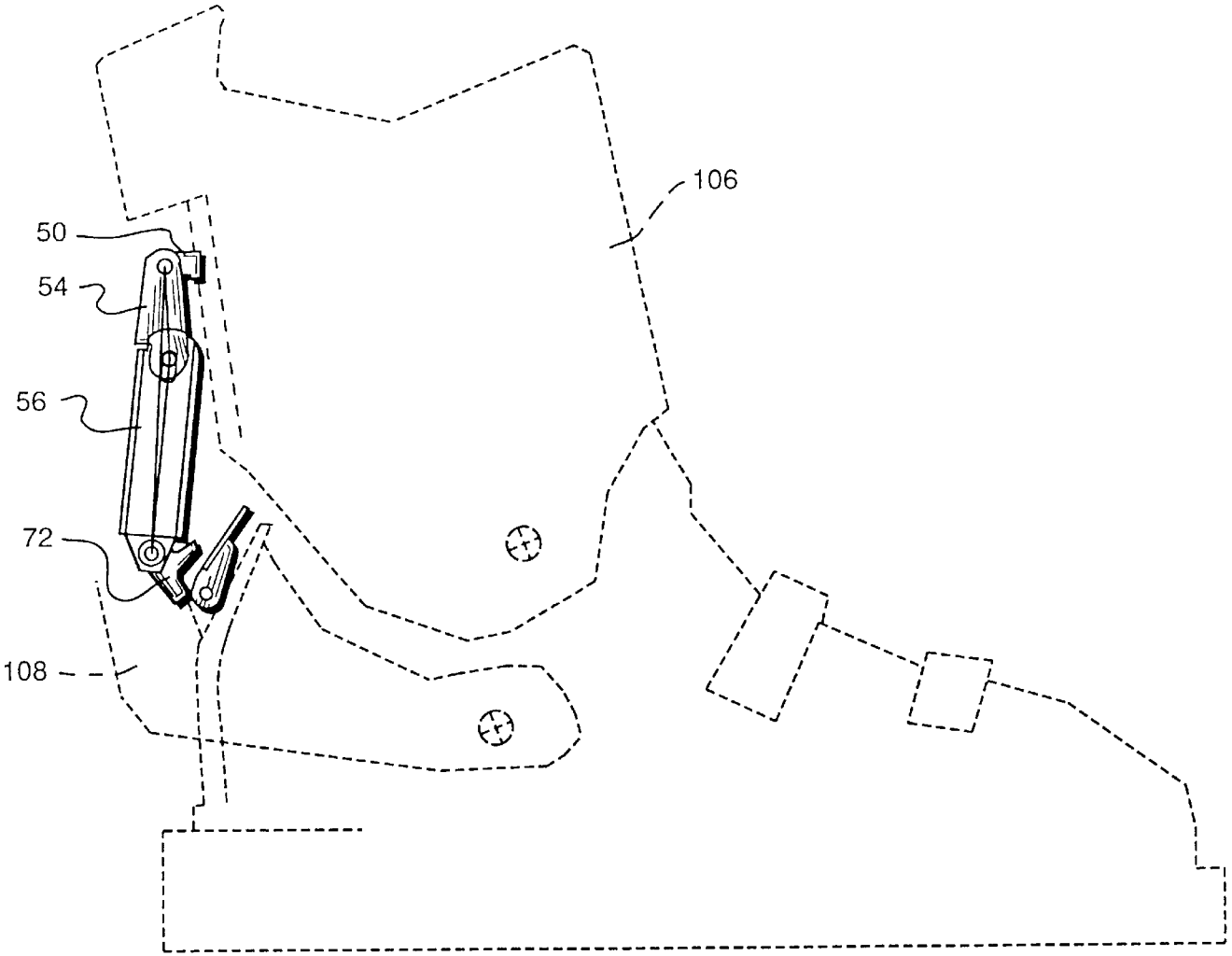

FIGS. 6–8 best illustrate in side elevational view the release and retention mechanism in both retention and release positions. As illustrated therein, when in ski or retention position, as shown in FIG. 6, the lower arm linkage 56 is urged against the upper shaft 100 of the boot. In addition, shown at 102 is the space or opening as between upper arm linkage 54 and lower arm linkage 56. Also, slot 68 reveals in FIG. 6 that when in the ski position, the short hinge pin head 82 is positioned at the top of the slot 68, due to spring 66 counter force or extension force. In the event of a rearward fall, the skier would lean back on the release and retention mechanism, and load transfer would occur through the mechanism to the bottom of said mechanism, as more particularly illustrated in FIG. 7. As can be seen in FIG. 11, upper arm linkage 54 has been urged downward in slot 68, and pin head 82 is now positioned at the bottom of said slot. In this position, spring 66 has been compressed downward. At this point in time, it can also be seen that space 102 no longer exists, as the edges of the upper arm linkage 54 and lower arm linkage are in contact, as shown at 104. The contact provokes rearrangement into the release position, FIG. 8, by means of forming a fulcrum contact point 104 upon which further compression of spring 66 and the concommitant downward travel of upper arm linkage 54 in slot 68 urges parts 56 and 54 to rotate away from the upper shaft 100 of the boot, by transferring loads from the stable center of spring 66 to the unstable contact point 104. The rearrangement of the upper and lower arm linkages in this manner allows the upper shaft (boot cuff) to rotate posteriorly until its' travel is arrested by contacting the stationary stirrup (lower boot shaft element) and the folded/rearranged release and retention mechanism housed in the stirrup, this arrest occuring at about 0 degrees forward lean. Cam 72 remains in a stable supporting position during ACL release mode. When the skier is able to rotate the upper shaft element (cuff) forward again the upper and lower arm linkages will rearrange into the stable ski position with the help of spring 52.

Figure 9:
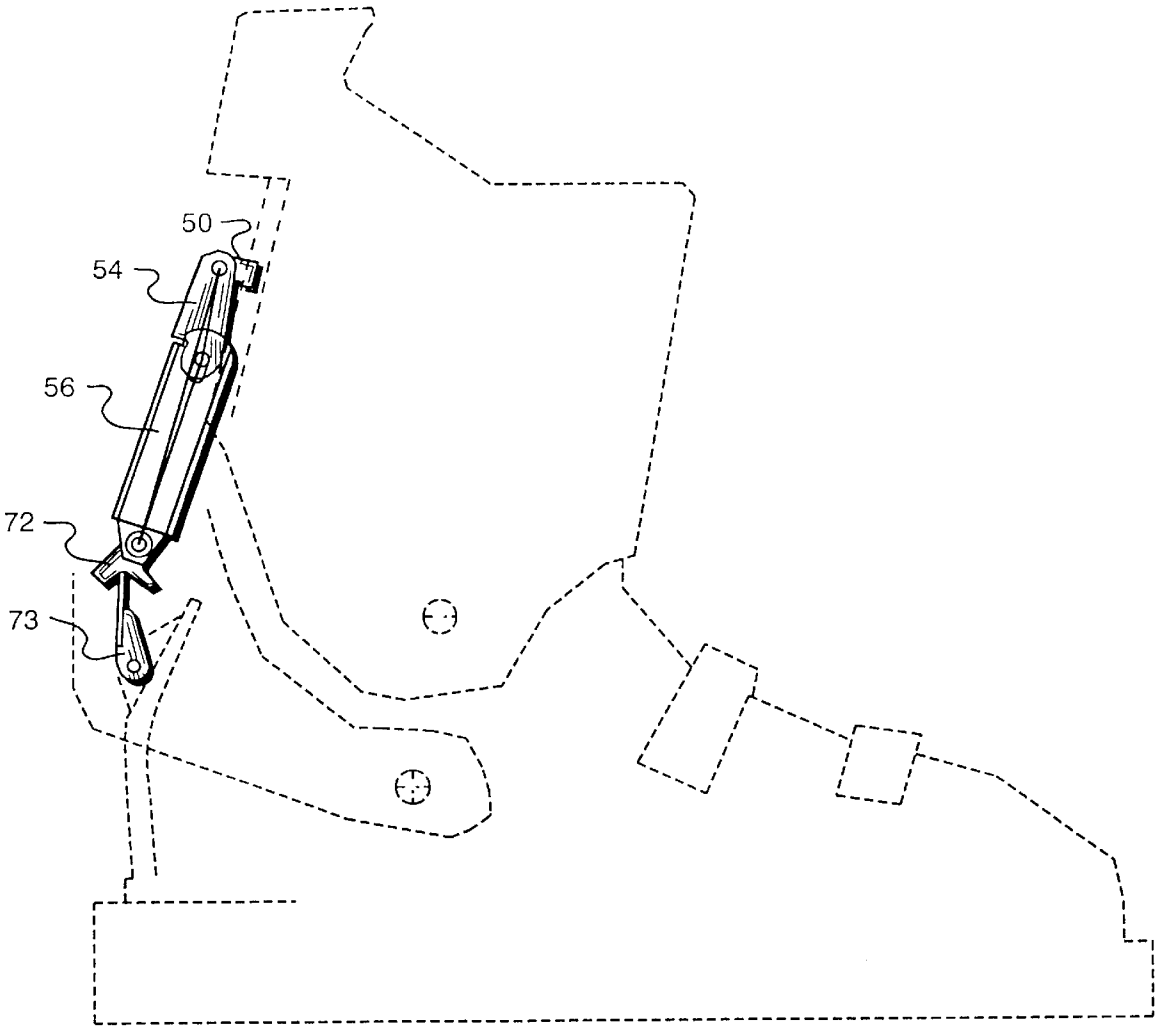
FIGS. 9–12 illustrate the retention and release mechanism on a ski boot.
Figure 10:
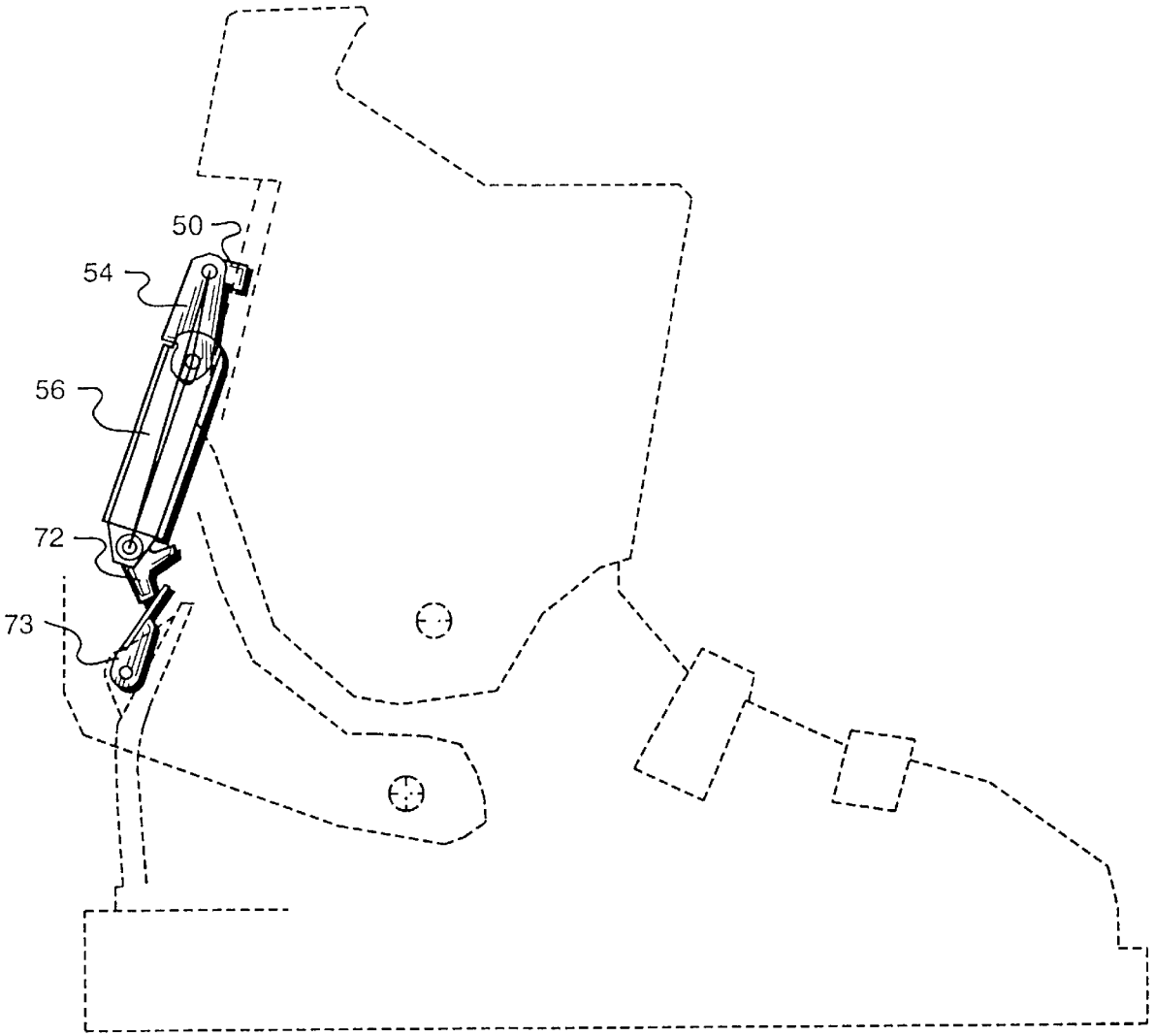
Figure 12:
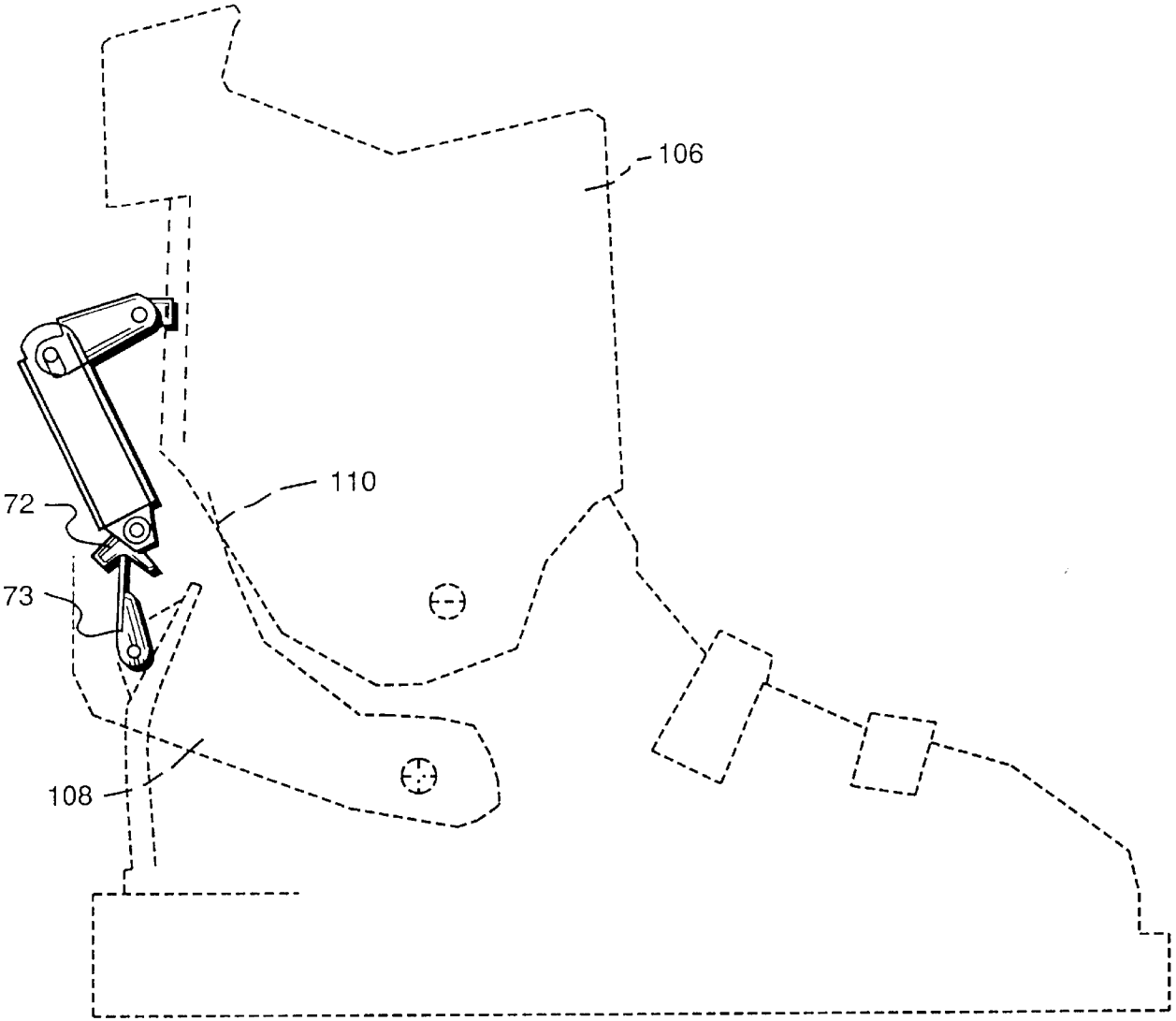

FIG. 9 illustrates the ski position, and note therein the stable relationships of the arm linkages and cam 72 on the latch 73. FIG. 10 shows cam 72 being switched by a manual interface (not shown) thereby causing an unstable relationship between cam 72 and the latch 73. FIG. 11 shows both boot upper shaft (cuff element) 106 and boot stirrup (lower shaft/cuff element) 108 rotating posteriorly on their respective axis to permit a normal walking gait or to facilitate egress or ingress, as a result of manual switching. FIG. 12 illustrates the relationship of the arm linkages and the boot upper shaft 106 and boot stirrup 108 in the ACL release position. As illustrated therein, the release and retention mechanism when releases provides a substantially vertical position to the skier. Furthermore, and as noted above, when in release position the rearrangement of the upper and lower arm linkages allows the upper shaft cuff element 106 of the boot to rotate posteriorly at which point it is prevented from further travel by contacting the stationary stirrup 108. The contact point is shown in FIG. 12 at 110.

There is thus provided to a retention and release mechanism offering sufficient rearward displacement of the boot shaft to increase the tendency of the knee joint of the wearer to extend to a degree that reduces the likelihood that injury to the anterior cruciate ligament of the knee will occur.

The invention relates to a ski boot having high rearward upper shaft resistance to flex to provide typical performance found in contemporary ski boots until a rearward force approaching that sufficient to damage the knee is encountered whereby the release and retention mechanism will allow the upper boot shaft to freely rotate rearwards for a small distance sufficient to protect the knee yet enable the skier to maintain control of the ski in a new position until the skier can resume a normal forward skiing posture at which point the retention feature of the invention will engage and support the leg posteriorly until the same potentially injurious posterior force level is again encountered. Alternatively, if the skier cannot recover control after the release episode, the effective moment arm of the ski tail to the knee being shortened increases the likelihood that the skier will fall over the tail of his ski without damaging knee ligaments.

Finally, it will be appreciated to those skilled in the art, using no more than routine experimentation, that equivalents to the specific embodiments of the present invention can be prepared, and such equivalents are intended to be encompassed by the following claims.

I claim:

1. A ski boot comprising a rigid foot portion having a rigid base and a rigid upper for surrounding a foot of a wearer;

a rigid leg element for surrounding essentially a lower portion of a leg of the wearer including a pivot;

the foot portion and the leg element being connected through the pivot to constitute a forward leaning retention position for said wearer;

a release and retention mechanism for changing the rigid leg element from a retention position into a substantially vertical release stop position, said release stop position being the result of a predetermined rearward force of the wearer's leg on the leg element, the release mechanism comprising an upper arm linkage pivotally connected to the leg element and engaged to a lower arm linkage through a slot, said lower arm linkage being connected to the foot portion, said upper and lower arm linkage including contact portions at locations offset from the axis of the upper and lower arm linkages, the release mechanism converting said rearward force into a substantially downward force which force causes the upper arm linkage to travel downwardly in said slot to a position where said contact portions of the lower arm linkage and upper arm linkage contact one another in order to force the linkage arms to pivot outwardly from said boot to position the wearer's leg into said release stop position.

2. The release and retention mechanism of claim 1, wherein said lower arm linkage is connected to a lower cam which is connected to a mounting bracket which is connected to a lower boot stirrup, said cam being supported by a latch pivotally connected to the foot portion, wherein said cam can be adjusted into a non-supported position with respect to said latch at which point posterior rotation can take place at both lower boot upper shaft and boot stirrup locations.

3. The release and retention mechanism of claim 1, wherein the retention position comprises a forward leaning position of about 12 to 15 degrees, and said release stop position is about 0 to −3 degrees.

4. The release and retention mechanism of claim 1, wherein the outward pivot of said upper and lower arm linkage is forced by contact of a lower edge of said upper arm linkage and an upper edge of said lower arm linkage.

5. The release and retention mechanism of claim 1, wherein the release and retention mechanism comprises a plate affixed to said boot, a spring connected to said plate and to an upper arm linkage, said spring forcing said plate against said boot, a lower arm linkage pivotally connected through a slot to said upper arm linkage, a spring compression cap also connected to the lower arm linkage, an adjustment screw connected to said compression cap, said adjustment screw containing a compression nut being connected to an adjustment screw thrust plate, and a tension spring surrounding said adjustment screw, wherein said spring exerts an upward force on said spring compression cap and a downward force on said compression nut, and further including a lower cam connected to said adjustment screw thrust plate, said lower cam connected to a stirrup mounting bracket, which bracket pivots between a retention and release position.

6. The release and retention mechanism of claim 5, wherein the retention position is a forward leaning position of about 12 degrees, and wherein the release position is substantially vertical.

7. The release and retention mechanism of claim 6, and including an opening in said upper arm linkage so that when in the release position access is provided to said adjustment screw.

8. The release and retention mechanism of claim 6, wherein adjustment of screw alters the compression of the spring.

9. The release and retention mechanism of claim 6, wherein said adjustment screw is contained within said tension spring.

10. A ski boot according to claim 1, wherein said release and retention mechanism further comprises a latch connecting the lower arm linkage to the foot portion, said latch being releasable to disconnect said lower arm linkage from said foot portion to position the skier in a rear inclined walking position.

* * * * *